US008877123B2

(12) United States Patent
Zhuang et al.

(10) Patent No.: US 8,877,123 B2
(45) Date of Patent: Nov. 4, 2014

(54) AL—CU ALLOY PRODUCT SUITABLE FOR AEROSPACE APPLICATION

(75) Inventors: Linzhong Zhuang, Beverwijk (NL); Shangping Chen, Delft (NL); Andrew Norman, Beverwijk (NL)

(73) Assignee: Aleris Aluminum Koblenz GmbH, Koblenz (DE)

( * ) Notice: Subject to any disclaimer, the term of this patent is extended or adjusted under 35 U.S.C. 154(b) by 882 days.

(21) Appl. No.: 12/523,289

(22) PCT Filed: Feb. 28, 2008

(86) PCT No.: PCT/EP2008/001586

§ 371 (c)(1),
(2), (4) Date: Dec. 3, 2009

(87) PCT Pub. No.: WO2008/110269

PCT Pub. Date: Sep. 18, 2008

(65) Prior Publication Data

US 2010/0089502 A1 Apr. 15, 2010

Related U.S. Application Data

(60) Provisional application No. 60/895,823, filed on Mar. 20, 2007.

(30) Foreign Application Priority Data

Mar. 14, 2007 (EP) ..... 07005247

(51) Int. Cl.

| | |
|---|---|
| ***C22F 1/057*** | (2006.01) |
| ***C22C 21/00*** | (2006.01) |
| ***C22C 21/16*** | (2006.01) |

(52) U.S. Cl.

USPC ..... 420/534; 420/535; 148/550; 148/417; 148/439; 148/552

(58) Field of Classification Search

CPC ..... C22F 1/04; C22C 21/16
USPC ..... 148/550, 417, 439, 552; 420/553, 534, 420/535

See application file for complete search history.

(56) References Cited

U.S. PATENT DOCUMENTS 3,561,954 A 2/1971 Brook
3,619,181 A * 11/1971 Willey ..... 420/538

(Continued)

FOREIGN PATENT DOCUMENTS

| | | | |
|---|---|---|---|
| EP | 1382698 | A1 | 1/2004 |
| FR | 1602294 | | 11/1970 |
| WO | 2004/111282 | A1 | 12/2004 |

OTHER PUBLICATIONS

Brook, "The influence of trace elements on the control of properties of high-strength creep resistant alloys," Aluminium Alloys in the Aircraft Industry (Turin, Italy), 1978, pp. 185-195.

(Continued)

*Primary Examiner* — Jessee Roe

(74) *Attorney, Agent, or Firm* — Novak Druce Connolly Bove + Quigg LLP

(57) ABSTRACT

The invention relates to an age-hardenable aluminium alloy product for structural members having a chemical composition including, in wt. %: Cu about 3.6 to 6.0%, Mg about 0.15 to 1.2%, Ge about 0.15 to 1.1%, Si about 0.1 to 0.8%, Fe<0.25%, balance aluminium and normal and/or inevitable elements and impurities. Zn, Ag and/or Ni may or may not be present. A typical range for Zn is <0.3 or, in a further embodiment about 0.3 to 1.3%. A typical range for Ag is <0.1 or, in a further embodiment about 0.1 to 1.0%. Products made from this aluminium alloy product are very suitable for aerospace applications. The alloy can be processed to various product forms, e.g. sheet, thin plate, thick plate, extruded or forged products. Products made from this alloy can be used also as a cast product, ideally as die-cast product.

17 Claims, 3 Drawing Sheets

(56) References Cited

U.S. PATENT DOCUMENTS

| | | | | |
|---|---|---|---|---|
| 5,055,257 | A * | 10/1991 | Chakrabarti et al. | 148/564 |
| 5,879,475 | A | 3/1999 | Karabin | |
| 5,980,657 | A | 11/1999 | Farrar | |
| 6,297,156 | B1 | 10/2001 | Farrar et al. | |
| 7,294,213 | B2 | 11/2007 | Warner | |
| 2003/0010411 | A1 | 1/2003 | Mitlin et al. | |
| 2004/0086418 | A1 | 5/2004 | Warner | |
| 2005/0081965 | A1 * | 4/2005 | Benedictus et al. | 148/552 |
| 2008/0210350 | A1 | 9/2008 | Warner | |

OTHER PUBLICATIONS

Ringer et al., "APFIM/TEM Observations of a High Strength-Creep Resistant Al—Cu—Mg—Si—Ge Alloy," Materials Science Forum, vols. 217-222 (1996) pp. 689-694.

Zolotorevskii et al., The Effect of Additions of Mg + Ce and Mg + Si on the Mechanical Characteristics and Structure of Cast Alloys of the Aluminium—Copper System, Soviet: Non-Ferrous Metal., 1983, (5), pp. 393-398.

Quan et al., "Internal Precipitate Structure in an Al—Cu—Mg—Ge—Ag Alloy," Proceedings of Materials 98, The Biennial Conference of the Institute of Materials Engineering, Australasia, Ltd., pp. 621-626.

ASM Specialty Handbook, Aluminum and Aluminum Alloys, ASM International, 1993, pp. 653-654.

Opposition to European patent application No. 2121997B1 (Jun. 20, 2011).

Polymear, "Control of Precipitation Processes and Properties in Aged Aluminium Alloys by Trace Element Additions", Department of Materials Engineering, Monash University, Clayton, Victoria 3168, Australia, Proceedings of ICAA-6, vol. 1, pp. 75-86 (1998).

Maksimovic et al., "The Effects of Microalloying with Silicon and Germanium on Microstructure and Hardness of a Commercial Aluminum Alloy", J. Serb. Chem. Soc., vol. 68, No. 11, pp. 893-901 (2003).

* cited by examiner

AL—CU ALLOY PRODUCT SUITABLE FOR AEROSPACE APPLICATION

This application is a §371 National Stage Application of International Application No. PCT/EP2008/001586, filed on 28 Feb. 2008, claiming the priority of European Patent Application No. 07005247.7 filed on 14 Mar. 2007 and US Provisional Application No. 60/895,823 filed 20 Mar. 2007.

FIELD OF THE INVENTION

The invention relates to an aluminium alloy, in particular an age-hardenable Al—Cu type alloy product for structural members, the alloy product combining a high strength with high toughness. Products made from this aluminium alloy product are very suitable for aerospace applications, but not limited to that. The alloy can be processed to various product forms, e.g. sheet, thin plate, thick plate, extruded or forged products. Products made from this alloy can be used also as a cast product, ideally as die-cast product.

BACKGROUND TO THE INVENTION

As will be appreciated herein below, except as otherwise indicated, alloy designations and temper designations refer to the Aluminum Association designations in Aluminum Standards and Data and the Registration Records, as published by the Aluminum Association in 2006.

For any description of alloy compositions or preferred alloy compositions, all references to percentages are by weight percent unless otherwise indicated.

Designers and manufacturers in particular in the aerospace industry are constantly trying to improve fuel efficiency, product performance and constantly trying to reduce manufacturing, maintenance and service costs. One way of achieving these goals is by improving the relevant properties of the used aluminium alloys so that a structure made from a particular alloy can be designed more effectively or will have a better overall performance. By improving the relevant material properties for a particular application, also the service costs can be significantly reduced by longer inspection intervals of the structure such as an aeroplane.

The main application of AA2000 series aluminium alloys in aeroplanes is as fuselage or skin plate, for which purpose typically AA2024 and AA2524 in the T351 temper are used or as lower wing plate for which purpose typically AA2024 in the T351 temper and AA2324 in the T39 temper is used. For these applications high tensile strength and high toughness are required. It is known that these properties of an AA2000 series aluminium alloy can be improved by higher levels of alloying elements such as Cu, Mg and Ag. In these types of alloy products the levels of Fe and Si are being kept at a levels as low as practical, for both elements typically each <0.1 and more preferably <0.07, in order to maintain the desired level of damage tolerance properties.

The most commonly used aluminium alloys form the AA2000-type series for aerospace application are AA2024, AA2024HDT ("High Damage Tolerant") and AA2324.

For newly designed aeroplanes, there is a wish for even better properties of the aluminium alloys than the known alloys have in order to design aeroplanes which are more manufacturing and operationally cost effective. Accordingly, a need exists for an aluminium alloy capable of achieving an improved balance of properties of the aluminium alloy in the relevant form.

SUMMARY OF THE INVENTION

It is an object of the present invention to provide an age-hardenable AlCu-type alloy product, ideally for structural members, having a balance of high strength and high toughness.

It is yet another object of the present invention to provide a method of manufacturing such an aluminium alloy product.

These and other objects and further advantages are met or exceeded by the present invention in which there is provided an age-hardenable aluminium alloy product for structural members having a chemical composition comprising, in wt. %:

Cu about 3.6 to 6.0%, preferably about 4.0 to 6.0%,
Mg about 0.15 to 1.2%, preferably about 0.2 to 0.9%,
Ge about 0.15 to 1.1%, preferably about 0.4 to 1.0%,
Si about 0.1 to 0.8%, preferably about 0.2 to 0.7%,
Fe<0.25%,
balance aluminium and normal and/or inevitable elements and impurities.

Zn may or may not be present. A typical range for Zn is <0.3 or, in a further embodiment about 0.3 to 1.3%.

Ag may or may not be present. A typical range for Ag is <0.1 or, in a further embodiment about 0.1 to 1.0%.

DETAILED DESCRIPTION OF THE PREFERRED EMBODIMENTS

Figure 1:
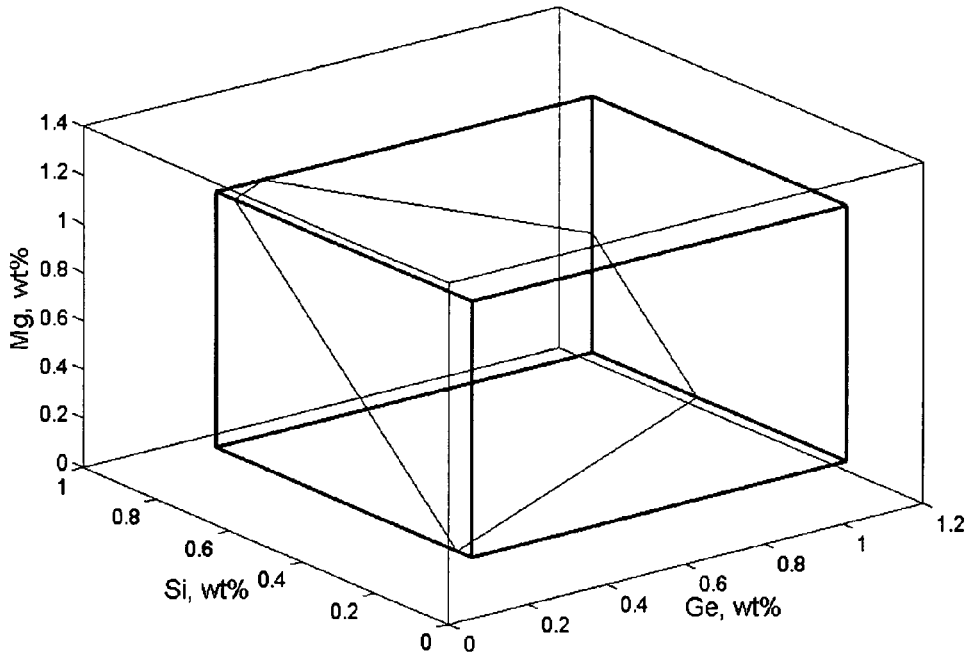
FIG. 1 is an Ge—Mg—Si diagram setting out the broadest Ge—Mg—Si ranges (in wt. %) for the aluminium alloy product according to this invention, together with the most preferred maximum Si-content to avoid any excess Si in the age-hardened alloy product.

As mentioned above, in its product respects, the present invention provides an age-hardenable aluminium alloy product for structural members having a chemical composition comprising, in wt. %:

Cu about 3.6 to 6.0%, preferably about 4.0 to 6.0%,
Mg about 0.15 to 1.2%, preferably about 0.2 to 0.9%,
Ge about 0.15 to 1.1%, preferably about 0.4 to 1.0%,
Si about 0.1 to 0.8%, preferably about 0.2 to 0.7%,
Fe<0.25%,
balance aluminium and normal and/or inevitable elements and impurities.

Zn may or may not be present. A typical range for Zn is <0.3 or, in a further embodiment about 0.3 to 1.3%.

Ag may or may not be present. A typical range for Ag is <0.1 or, in a further embodiment about 0.1 to 1.0%.

The Cu is added to the alloy product as it forms the most potentially strengthening element in the alloy. The Cu content should not be lower than about 3.6% to ensure high strength with accelerated ageing kinetics but should not be higher than 6.0% to avoid the formation of primary particles $Al_2Cu$, which result in the decrease of UPE and TS/Rp. A more preferred lower limit for the Cu content is about 4.0%, and more preferably about 4.2%. A more preferred upper limit for the Cu content is about 5.6%, and more preferably about 5.2%.

The alloying elements Ge, Si, and Mg are purposively added to further increase amongst others the strength, toughness and UPE of the alloy product. In the defined ranges it appears that two co-existing phases of Ge—Si and Mg—Si are formed having a synergetic effect on various engineering properties rendering the alloy product ideally suitable for load bearing applications. In the alloy according to this invention the presence of fine Si—Ge particles serve as heterogeneous precipitation sites for Θ" ($Al_2Cu$-phases) strengthening particles. At present it is believed the Si—Ge particles themselves do not contribute directly to the strength of the alloy product.

The lower limit for the Ge addition is about 0.15%, and preferably about 0.4%. The Ge addition should not be too high because a too high level of Ge contributes to the formation of Ge—Si eutectic phase, which has a lower melting temperature. With the addition of Ge and Si a higher strength and also an improved UPE can be obtained. However, it has been found that at the higher end of the Ge range, the UPE value and TS/Rp ratio decrease although the strength further increases. The upper limit for the Ge addition is about 1.1%, preferably about 1.0% and more preferably about 0.9%.

It has been found that Mg shows a similar function as Ge in the acceleration of the ageing kinetics when it is added together with Si. Moreover, it has been found that Mg contributes more to the strength and the UPE than Ge does because $Mg_2Si$ precipitates have a strong hardening effect and the coexistence of two types of precipitates lead to an optimal distribution of the hardening phases in the alloy matrix.

The content of Mg should be controlled to avoid too much S' phase instead of $Mg_2Si$ precipitates. The upper limit for the Mg content is about 1.2%, and preferably about 1.0%, and more preferably about 0.8%. In order to have a beneficial effect of the Mg addition the lower limit is about 0.15%, and preferably about 0.2%.

The Si added reacts with both the Ge and the Mg, and should be at least about 0.1%, preferably about 0.2%, and more preferably about 0.3%. The upper limit for the Si content is about 0.8%, and preferably about 0.7%.

In a preferred embodiment the maximum Si addition, $[Si]_{max}$, is a function of the Mg and Ge content in the alloy product, and which function reads as follows, all concentrations are in wt. %:

$$[Si]_{max} \leq (([Mg]+0.67[Ge])/1.73)+0.15.$$

In a more preferred embodiment the function reads as follows:

$$[Si]_{max} \leq (([Mg]+0.67[Ge])/1.73)+0.1.$$

And in the most preferred embodiment the Mg and Ge and Si additions are in a stoichiometric ratio, such that the upper-limit for the Si-content is defined by:

$$[Si]_{max} \leq ([Mg]+0.67[Ge])/1.73.$$

In the alloy product according to this invention in the age-hardened condition there should as little excess Si present as possible. In an ideal situation all the Si added is consumed for the desirable formation of Ge—Si and Mg—Si phases for the improvement of the engineering properties of the alloy product. In practice some excess Si can be present due to measurement and control inaccuracy and some Si can be tied up by the Fe present in the alloy product. However, it has been found that the considerable amounts of excess Si may have an adverse effect on the damage tolerance properties of the alloy product, which properties are of relevance in particular when the alloy product is used in aerospace applications.

The Fe content for the alloy product should be less than 0.25%. When the alloy product is used for aerospace application the lower-end of this range is preferred, e.g. less than about 0.10%, and more preferably less than about 0.08% to maintain in particular the toughness at a sufficiently high level. Where the alloy product is used for commercial applications, such as tooling plate, a higher Fe content can be tolerated. However, it is believed that also for aerospace application a moderate Fe content, for example about 0.09 to 0.13%, or even about 0.10 to 0.15%, can be used. A low Fe-content is also preferred as it can tie up some of the Si, thereby reducing the effective amount of Si available for the desired interaction with Ge and Mg.

The Zn and Ag are present as impurities which can be tolerated to somewhat higher levels without adversely affecting relevant properties.

The alloy product can contain normal and/or inevitable elements and impurities, typically each <0.05% and the total <0.2%, and the balance is made by aluminium.

In an embodiment of the alloy product according to this invention it further comprises one or more dispersoid forming elements to increase the strength, amongst other properties, of the alloy product, selected from the group consisting of, in wt. %:

Mn about 0.06 to 0.8%, preferably about 0.15 to 0.5%, and more preferably about 0.2 to 0.45%,
Zr about 0.02 to 0.4%, preferably about 0.04 to 0.2%,
Ti about 0.01 to 0.2%, preferably about 0.01 to 0.1%,
V about 0.02 to 0.4%, preferably about 0.06 to 0.2%,
Hf about 0.01 to 0.4%
Cr about 0.02 to 0.4%, preferably about 0.04 to 0.2%,
Sc about 0.03 to 0.5%.

In a further embodiment of the alloy product according to this invention it further comprises one or more elements selected from the group consisting of, in wt. %:

Ag about 0.1 to 1.0%,
Zn about 0.3 to 1.3%,
Ni about 0.1 to 2.3%.

In an embodiment of the alloy product the Zn is present as an impurity element which can be tolerated to a level of at most about 0.3%, and preferably at most about 0.20%. In another embodiment of the alloy product the Zn is purposively added to improve the damage tolerance properties of the alloy product. In this embodiment the Zn is typically present in a range of about 0.3 to 1.3%, and more preferably in a range of 0.45 to 1.1%.

If added in particular as a strengthening element, the Ag addition should not exceed 1.0%, and a preferred lower limit is about 0.1%. A preferred range for the Ag addition is about 0.20-0.8%. A more suitable range for the Ag addition is in the range of about 0.20 to 0.60%, and more preferably of about 0.25 to 0.50%, and most preferably in a range of about 0.3 to 0.48%. In the embodiment where Ag it is not purposively added it is preferably kept at a low level of preferably <0.02%, more preferably <0.01%.

In the embodiment where Ni is added, it is preferably in a range of about 0.1 to 2.3% in order to further improve the thermal stability of the alloy product. A more preferred lower limit for Ni content is about 0.25%, and a more preferred upper limit is about 1.9%.

In an embodiment of the alloy product the product is in the form of a rolled, extruded or forged product, and more preferably the product is in the form of a sheet, plate, forging or extrusion as part of an aircraft structural part.

When used as part of an aircraft structural part the part can be for example a fuselage sheet, upper wing plate, lower wing plate, thick plate for machined parts, forging or thin sheet for stringers.

In a further aspect of the invention it relates to a method of manufacturing a wrought aluminium alloy product of an AA2000-series alloy, the method comprising the steps of:

a. casting stock of an ingot of an AlCuGeSiMg-alloy according to this invention, b. preheating and/or homogenizing the cast stock;

c. hot working the stock by one or more methods selected from the group consisting of rolling, extrusion, and forging;

d. optionally cold working the hot worked stock;

e. solution heat treating (SHT) of the hot worked and/or optionally cold worked stock, the SHT is carried out at a temperature and time sufficient to place into solid solution the soluble constituents in the aluminium alloy;

f. cooling the SHT stock, preferably by one of spray quenching or immersion quenching in water or other quenching media;

g. optionally stretching or compressing the cooled SHT stock or otherwise cold working the cooled SHT stock to relieve stresses, for example levelling or drawing or cold rolling of the cooled SHT stock;

h. ageing, preferably artificial ageing, of the cooled and optionally stretched or compressed or otherwise cold worked SHT stock to achieve a desired temper.

The aluminium alloy can be provided as an ingot or slab or billet for fabrication into a suitable wrought product by casting techniques in the art for cast products, e.g. DC-casting, EMC-casting, EMS-casting. Slabs resulting from continuous casting, e.g. belt casters or roll casters, also may be used, which in particular may be advantageous when producing thinner gauge end products. Grain refiners such as those containing titanium and boron, or titanium and carbon, may also be used as is known in the art. After casting the alloy stock, the ingot is commonly scalped to remove segregation zones near the cast surface of the ingot.

Homogenisation treatment is typically carried out in one or multiple steps, each step having a temperature in the range of about 480 to 535° C. The pre-heat temperature involves heating the hot working stock to the hot-working entry temperature, which is typically in a temperature range of about 420 to 465° C.

Following the preheat and/or homogenisation practice the stock can be hot worked by one or more methods selected from the group consisting of rolling, extrusion, and forging, preferably using regular industry practice. The method of hot rolling is preferred for the present invention.

The hot working, and hot rolling in particular, may be performed to a final gauge, e.g. 3 mm or less or alternatively thick gauge products. Alternatively, the hot working step can be performed to provide stock at intermediate gauge, typical sheet or thin plate. Thereafter, this stock at intermediate gauge can be cold worked, e.g. by means of rolling, to a final gauge. Depending on the alloy composition and the amount of cold work an intermediate anneal may be used before or during the cold working operation.

Solution heat-treatment (SHT) is typically carried out within the same temperature range as used for homogenisation, although the soaking times that are chosen can be somewhat shorter. Following the SHT the stock is rapidly cooled or quenched, preferably by one of spray quenching or immersion quenching in water or other quenching media.

The SHT and quenched stock may be further cold worked, for example, by stretching in the range of about 0.5 to 15% of its original length to relieve residual stresses therein and to improve the flatness of the product. Preferably the stretching is in the range of about 0.5 to 6%, more preferably of about 0.5 to 5%.

After cooling the stock is aged, typically at ambient temperatures, and/or alternatively the stock can be artificially aged. Depending on the alloy system this ageing can de done by natural ageing, typically at ambient temperatures, or alternatively by means of artificially ageing.

It has been found that the alloy products according to the invention have considerably faster artificial ageing kinetics compared to alloys devoid of the Ge—Mg—Si in the defined ranges. For example the T6 peak ageing of AlCuGeMgSi alloys appears at about 3 hrs/190° C. in comparison with about 12 hrs/190° C. for AlCu alloys. Artificial peak ageing is preferably carried out in a time span of about 2 to 8 hours. Furthermore it has been found that the ageing curves for the alloy products according to this invention show a much wider peak in time span that the AlCu alloys, which indicates slow coarsening kinetics of the relevant precipitates, resulting in a favourable higher thermal stability.

A desired structural shape is then machined from these heat treated plate sections, more often generally after artificial ageing, for example, an integral wing spar. SHT, quench, optional stress relief operations and artificial ageing are also employed in the manufacture of thick sections made by extrusion and/or forged processing steps.

The age-hardenable AlCu alloy products according to this invention may be provided with a cladding, in particular when used as aircraft fuselages. Such clad products utilise a core of the aluminium base alloy of the invention and a cladding of usually higher purity which in particular corrosion protects the core. The cladding includes, but is not limited to, essentially unalloyed aluminium or aluminium containing not more than 0.1 or 1% of all other elements. Aluminum alloys herein designated AA1xxx-type series include all Aluminum Association (AA) alloys, including the sub-classes of the 1000-type, 1100-type, 1200-type and 1300-type. Thus, the cladding on the core may be selected from various Aluminum Association alloys such as 1060, 1045, 1050, 1100, 1200, 1230, 1135, 1235, 1435, 1145, 1345, 1250, 1350, 1170, 1175, 1180, 1185, 1285, 1188, or 1199. In addition to the preferred use of an AA1xxx-type cladding, alloys of the AA7000-series alloys, such as 7072 containing zinc (0.8 to 1.3%) or having about 0.3 to 0.7% Zn, can serve as the cladding and alloys of the AA6000-series alloys, such as 6003 or 6253, which contain typically more than 1% of alloying additions, can serve as cladding. The clad layer or layers are usually much thinner than the core, each constituting about 1 to 15 or 20 or possibly about 25% of the total composite thickness. A cladding layer more typically constitutes around 1 to 12% of the total composite thickness.

The age-hardenable AlCu-alloy product according to this invention can be used, amongst other uses, in the thickness range of at most 0.5 inch (12.5 mm) to have properties that will be excellent for fuselage sheet. In the thin plate thickness range of 0.7 to 3 inch (17.7 to 76 mm) the properties will be excellent for wing plate, e.g. lower wing plate. The thin plate thickness range can be used also for stringers or to form an integral wing panel and stringer for use in an aircraft wing structure. When processed to thicker gauges of more than 2.5 inch (63 mm) to about 11 inch (280 mm) excellent properties have been obtained for integral part machined from plates, or to form an integral spar for use in an aircraft wing structure, or in the form of a rib for use in an aircraft wing structure. The thicker gauge products can be used also as tooling plate, e.g. moulds for manufacturing formed plastic products, for example via die-casting or injection moulding. The alloy products according to the invention can also be provided in the form of a stepped extrusion or extruded spar for use in an aircraft structure, or in the form of a forged spar for use in an aircraft wing structure.

In another embodiment the alloy product according to this invention is provided as an aluminium casting or aluminium foundry alloy product, typically produced via die-casting. In this embodiment the aluminium casting is preferably provided in a T5, T6 or T7 temper. A T5 temper concerns a temper wherein after extracting from the die the product is immediately quenched, e.g. in water, and then artificially aged. A T6 temper concerns a temper wherein the product is SHT, quenched and artificially aged to maximum or near maximum strength. A T7 temper concerns a temper wherein the product is SHT, quenched and stabilised or aged beyond the point of maximum strength.

The aluminium cast product according to this invention can be used for automotive and aerospace applications, in particular applications requiring considerable load-bearing capabilities.

In a further aspect there is provided a method of producing cast product according to this invention comprises the steps of:

a. preparing an aluminium alloy melt having a composition according to this invention,
b. casting at least a portion of the melt in a mould configured to form the casting, preferably by means of die-casting, and
c. removing the casting from the mould.

In an embodiment of the casting method it further comprises subjecting the casting to an ageing treatment, preferably an artificial ageing treatment, and preferably to a SHT prior to the ageing treatment.

It is mentioned here that the purposive addition of Ge and Si to copper-copper based alloy is known for the production of integrated circuits, which are products far removed from the technical field of this invention concerning age-hardenable alloys having significant load-bearing capacity for structural members in for example the automotive and aerospace industry, such as sheet and plate suitable for wide body commercial aircraft fuselages.

FIG. 1 shows in a schematic manner the broadest Ge—Mg—Si ranges (in wt. %) for the alloy product according to this invention. More preferred ranges are not plotted in this diagram. The plane shown illustrates the most preferred embodiment wherein:

$$[Si]_{max}=(([Mg]+0.67[Ge])/1.73)$$

such that the Mg and Ge and Si are in a stoichiometric ratio.

In the following, the invention will be explained with reference to non-limiting embodiments according to the invention.

EXAMPLE 1

On a laboratory scale four aluminium alloys were cast to prove the principle of the current invention and processed into 2 mm sheet. The alloy compositions are listed in Table 1. For all ingots the balance was inevitable impurities and aluminium, and alloy D is an alloy composition according to this invention. Rolling blocks of approximately 80 by 80 by 100 mm (height×width×length) were sawn from round lab cast ingots of about 12 kg. The ingots were homogenised at 520±5° C. for about 24 hours and consequently slowly air cooled to mimic an industrial homogenisation process. The rolling ingots were pre-heated for about 4 hours at 450±5° C. and hot rolled to a gauge of 8 mm and subsequently cold rolled to a final gauge of 2 mm. The hot-rolled products were solution heat treated (SHT) for 3 hours at 515±5° C. and quenched in water. Depending on the temper the products were then cold stretched for 3% and artificially aged. Three tempers have been produced according to the following schedules:

T4-temper: after SHT and quenching, natural aging for more than 2 weeks.

T6-temper: after SHT and quenching, natural ageing for 2 weeks, peak-aged for 12 hrs@190° C. for alloy A and B, and 3 hrs@190° C. for alloys C and D.

T8-temper: after SHT and quenching, natural ageing for 2 weeks, 3% stretch, natural ageing for 1 week and peak-aged for 12 hrs@190° C. for alloy A and B, and 3 hrs@190° C. for alloys C and D.

For the alloys C and D a shorter ageing time has been used as it has been found that Ge-containing alloys have a faster ageing response.

Following the ageing the tensile properties have been determined according to EN10.002. The results are listed in Table 2, wherein "Rp" represents the yield strength, "Rm" represents the tensile strength and "Ag" the uniform elongation. For all alloys in the T6 temper also the respective tear-strengths have been determined according to ASTM B871-96, and the test directions of the results are for the T-L and L-T direction. The so-called notch-toughness can be obtained by dividing the tear-strength, obtained by the Kahn-tear test, by the tensile yield strength ("TS/Rp"). This typical result from the Kahn-tear test is known in the art to be a good indicator for true fracture toughness. The unit propagation energy ("UPE"), also obtained by the Kahn-tear test, is the energy needed for crack growth. It is commonly believed that the higher the UPE, the more difficult to grow the crack, which is a desired feature of the material.

TABLE 1

Chemical composition of the aluminium alloys cast. All percentages are by weight.

| | Alloying element | | | | | |
|---|---|---|---|---|---|---|
| Alloy | Cu | Ge | Si | Mg | Mn | Fe |
| A | 4.5 | — | 0.05 | — | 0.20 | 0.10 |
| B | 5.7 | — | 0.01 | — | 0.21 | 0.09 |
| C | 4.5 | 0.69 | 0.26 | — | 0.20 | 0.10 |
| D | 4.5 | 0.65 | 0.41 | 0.30 | 0.20 | 0.10 |

TABLE 2

Tensile properties of the alloys in different temper conditions.

| | T6 | | | T8 | | | T4 | | |
|---|---|---|---|---|---|---|---|---|---|
| Alloy | Rp MPa | Rm MPa | Ag % | Rp MPa | Rm MPa | Ag % | Rp MPa | Rm MPa | Ag % |
| A | 234 | 337 | 8.8 | 269 | 383 | 7.5 | 198 | 326 | 17.2 |
| B | 293 | 402 | 10.4 | 310 | 426 | 6.9 | 231 | 366 | 16.4 |
| C | 292 | 390 | 6.6 | 306 | 405 | 7.4 | 203 | 350 | 20.1 |
| D | 405 | 467 | 7.4 | 387 | 453 | 7.0 | 222 | 386 | 23.5 |

TABLE 3

Kahn-tear test results in the T6 temper for the different alloys.

| Alloy | Rp LT | UPE-LT kJ/m$^2$ | TS-LT MPa | TS-LT/ Rp-LT | UPE-TL kJ/m$^2$ | TS-TL MPa | TS-TL/ Rp-LT |
|---|---|---|---|---|---|---|---|
| A | 234 | 247 | 606 | 2.2 | 242 | 513 | 2.2 |
| B | 293 | 155 | 551 | 1.9 | 156 | 552 | 1.9 |
| C | 292 | 226 | 542 | 1.9 | 207 | 549 | 1.9 |
| D | 405 | 236 | 640 | 1.6 | 229 | 629 | 1.6 |

From the results of Table 2, from the comparison of alloys A and B, it can be seen that according to expectation that with increasing Cu content there is a strength increase as the Cu content increases. But for the results of Table 3 it can be seen that according to expectation for the alloys A and B with increasing strength the UPE and TS/Rp ratio decrease.

From the results of Table 2, from the comparison of alloys A and C, both alloys having the same Cu-content, it can be seen that with the addition of Ge and Si to the alloy product there is a considerable increase in strength in all temper conditions tested.

And from the results of Table 2, from the comparison of alloys A and D, it can be seen that, with the combined addition of Ge—Si—Mg, there is an even larger increase in strength in alloy tempers compared to the addition of only Ge—Si (alloy C).

Figure 2:
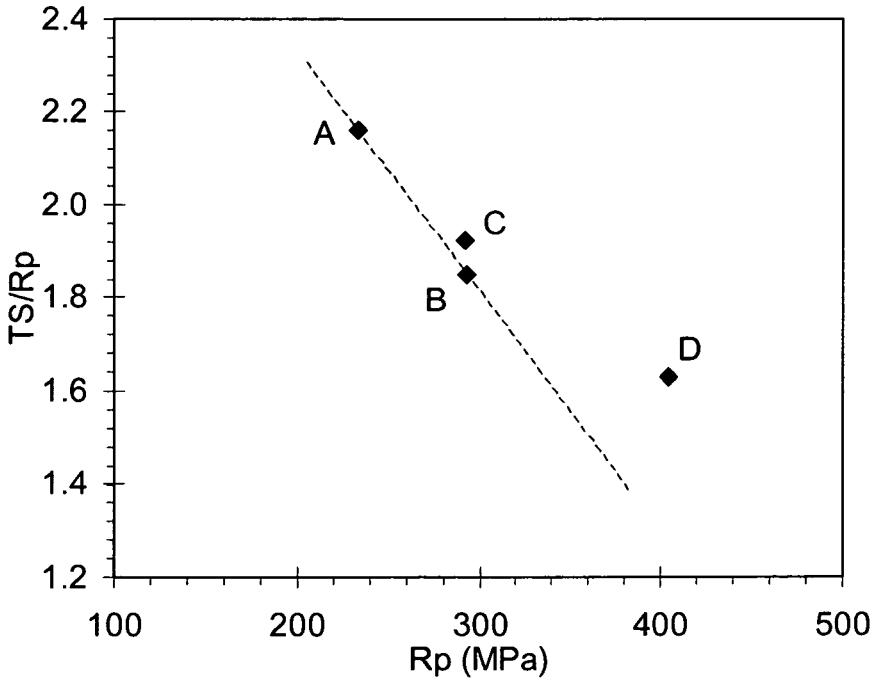
FIG. 2 shows a diagram of the yield strength versus toughness of the various alloys tested in the T6 temper.
Figure 3:
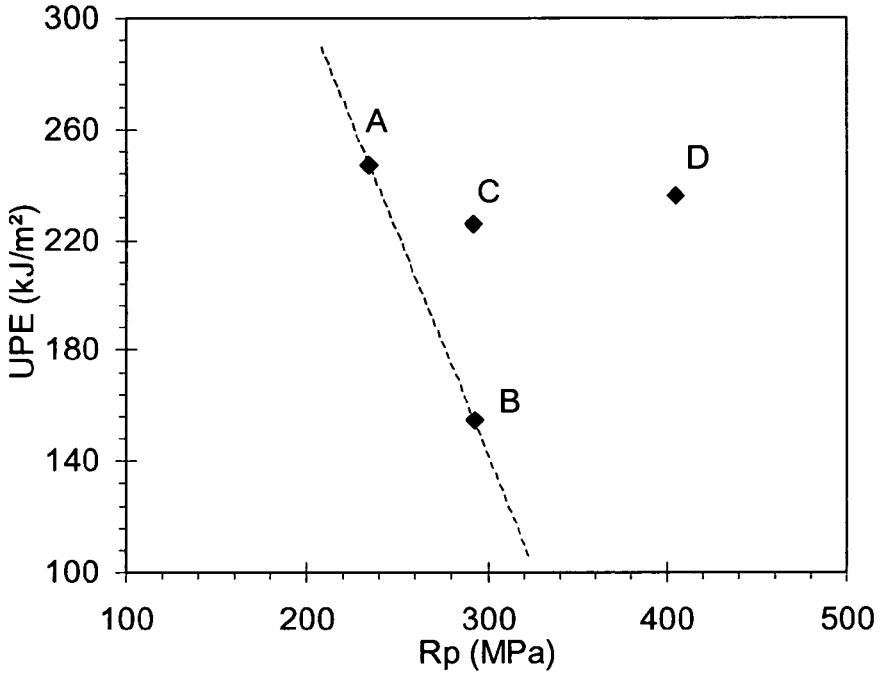
FIG. 3 shows a diagram of the yield strength versus the UPE of the various alloys tested in the T6 temper.

From the results of Table 3 it can be seen that, for the alloy product according to this invention, also the UPE and notch-toughness are significantly improved compared to the reference alloys. The results of Table 3 are also plotted in FIG. 2 and FIG. 3.

Thus the alloy product according to this invention offers a combination a very high strength with improved damage tolerance properties based on the tear strength and the UPE making the alloy product a favourable candidate for load-bearing applications such as for aerospace applications.

Having now fully described the invention, it will be apparent to one of ordinary skill in the art that many changes and modifications can be made without departing from the spirit or scope of the invention as herein described.

The invention claimed is:

1. An age-hardenable aluminium alloy product for structural members having a chemical composition comprising, in wt. %:

Cu about 4.5 to 5.2%
Mg about 0.2 to 0.3%
Ge about 0.65 to 0.69%
Si about 0.3 to 0.7%
Fe<0.25%,
Mn about 0.2 to 0.45%
balance aluminium and normal and/or inevitable elements and impurities, wherein the inevitable impurities are present at each <0.05% and the total <0.2%.

2. An aluminium alloy product according to claim 1, wherein the Fe content is at most about 0.10%.

3. An aluminium alloy product according to claim 1, and wherein $[Si]_{max} \leq (([Mg]+0.67[Ge])/1.73)+0.15$.

4. An aluminium alloy product according to claim 1, and wherein $[Si]_{max} \leq (([Mg]+0.67[Ge])/1.73)+0.1$.

5. An aluminium alloy product according to claim 1, $[Si]_{max} \leq ([Mg]+0.67[Ge])/1.73$.

6. An aluminium alloy product according to claim 1, wherein the product is in the form of a rolled, extruded or forged product.

7. An aluminium alloy product according to claim 1, wherein the product is in the form of a sheet, plate, forging or extrusion as part of an aircraft structural part.

8. An aluminium alloy product according to claim 1, wherein said product is in the form of a rolled, extruded or forged product and has been treated with a hot deformation operation, a solution heat-treatment, quenching, and ageing.

9. An aluminium alloy product according to claim 1, wherein said product is in the form of a rolled, extruded or forged product and has been treated with a solution heat-treatment, quenching and cold strain-hardening, and possesses a permanent deformation between 0.5 and 15%.

10. An aluminium alloy product according to claim 1, wherein said product is in the form of a rolled, extruded or forged product and has been treated with a solution heat-treatment, quenching and cold strain-hardening, and possesses a permanent deformation between 0.5 and 5%.

11. An aluminium alloy product according to claim 1, wherein the product is a sheet or plate product and is clad on at least one face thereof.

12. An aluminium alloy product according to claim 1, wherein the product is a cast product.

13. An aluminium alloy product according to claim 1, wherein the product is a die-cast product.

14. An age-hardenable aluminium alloy product for structural members having a chemical composition comprising, in wt. %:

Cu about 4.5 to 5.2%
Mg about 0.2 to 0.3%
Ge about 0.65 to 0.69%
Si about 0.3 to 0.7%
Fe<0.25%, one or more elements selected from the group consisting of, in wt.%:

Zr about 0.02 to 0.4%,
Ti about 0.01 to 0.2%,
V about 0.02 to 0.4%,
Hf about 0.01 to 0.4%,
Cr about 0.02 to 0.4%,
Sc about 0.03 to 0.5%; and balance aluminium and normal and/or inevitable elements and impurities, wherein the inevitable impurities are present at each <0.05% and the total <0.2%.

15. An aluminium alloy product according to claim 14, wherein the Zr content is in a range of about 0.04 to 0.2%.

16. An aluminium alloy product according to claim 14, wherein the Ti content is in a range of about 0.01 to 0.1%.

17. An aluminium alloy product according to claim 14, wherein the Cr content is in a range of about 0.04 to 0.2%.

* * * * *